US006986397B2

(12) United States Patent
Mattson et al.

(10) Patent No.: US 6,986,397 B2
(45) Date of Patent: Jan. 17, 2006

(54) POWER RIDING TRAILER FOR AN IMPLEMENT

(75) Inventors: Bryan Mattson, Belton, MI (US); Michael T. Powers, Woodland, MI (US)

(73) Assignee: Floorstyle Products, Inc., Hastings, MI (US)

( * ) Notice: Subject to any disclaimer, the term of this patent is extended or adjusted under 35 U.S.C. 154(b) by 43 days.

(21) Appl. No.: 10/377,277

(22) Filed: Feb. 28, 2003

(65) Prior Publication Data

US 2003/0196841 A1 Oct. 23, 2003

Related U.S. Application Data

(60) Provisional application No. 60/360,848, filed on Mar. 1, 2002.

(51) Int. Cl.

| | |
|---|---|
| ***B62M 7/14*** | (2006.01) |
| ***B62D 53/00*** | (2006.01) |
| ***B62D 63/00*** | (2006.01) |
| ***B24B 23/00*** | (2006.01) |
| ***A01D 34/03*** | (2006.01) |

(52) U.S. Cl. ..... 180/11; 180/14.1; 180/65.1; 180/65.8; 180/216; 451/350; 451/352; 451/353; 451/178; 451/59; 191/11; 56/10.1; 280/32.7

(58) Field of Classification Search ..... 180/11, 180/65.1, 295, 14.1, 305, 307, 65.8, 216; 125/13.01; 451/350, 351, 352, 353, 178, 451/59; 191/11; 56/10.1; 299/39.1; D32/15; 280/32.7

See application file for complete search history.

(56) References Cited

U.S. PATENT DOCUMENTS

| | | | | | |
|---|---|---|---|---|---|
| 3,161,994 | A | | 12/1964 | Neitzer, Jr. | |
| 3,575,250 | A | * | 4/1971 | Dykes | 180/11 |
| 3,818,292 | A | * | 6/1974 | Berman | 318/139 |
| 4,506,405 | A | * | 3/1985 | Block | 15/320 |
| 4,674,142 | A | * | 6/1987 | Meili | 15/49.1 |
| 4,716,980 | A | * | 1/1988 | Butler | 180/19.2 |
| 4,989,351 | A | * | 2/1991 | Shear | 37/242 |
| 5,033,564 | A | | 7/1991 | Mattson | |
| RE34,822 | E | | 1/1995 | Mattson | |
| 5,573,078 | A | * | 11/1996 | Stringer et al. | 180/19.2 |
| 5,615,933 | A | * | 4/1997 | Kidston et al. | 303/152 |
| 6,003,625 | A | * | 12/1999 | Neuling | 180/11 |
| 6,055,466 | A | * | 4/2000 | Grewe | 701/22 |
| 6,227,957 | B1 | | 5/2001 | Letatt et al. | |
| 6,254,462 | B1 | | 7/2001 | Kelton et al. | |
| 6,279,672 | B1 | * | 8/2001 | Losego | 180/65.1 |
| 6,419,565 | B2 | * | 7/2002 | Mattson et al. | 451/59 |
| 6,491,122 | B2 | * | 12/2002 | Leitner et al. | 180/65.8 |
| 6,492,785 | B1 | * | 12/2002 | Kasten et al. | 318/434 |
| 6,571,542 | B1 | * | 6/2003 | Fillman et al. | 56/10.6 |
| 6,575,819 | B2 | | 6/2003 | Beyersdorff | |

FOREIGN PATENT DOCUMENTS

| | | | |
|---|---|---|---|
| GB | 2071032 | A * | 9/1981 |

* cited by examiner

*Primary Examiner*—Christopher P. Ellis
*Assistant Examiner*—G B Klebe
(74) *Attorney, Agent, or Firm*—Stout, Uxa, Buyan & Mullins, LLP; Frank J. Uxa

(57) ABSTRACT

A riding trailer apparatus useful for controlling a floor treatment implement is provided including a frame, an operator support platform, and a hook-up mechanism structured to enable the apparatus to be operably coupled to one of various, conventional floor treatment implements. The apparatus also includes a drive assembly including a bi-directional DC motor and gear assembly, and an having an electronic controller with a speed board coupled thereto.

19 Claims, 4 Drawing Sheets

POWER RIDING TRAILER FOR AN IMPLEMENT

RELATED APPLICATION

This application claims the benefit of U.S. provisional application No. 60/360,848, filed on Mar. 1, 2002, which is incorporated herein in its entirety by this specific reference.

FIELD OF THE INVENTION

The present invention generally relates to floor treatment equipment, and more specifically relates to a power riding trailer for use in controlling, for example a speed and direction of, a floor treatment implement.

BACKGROUND OF THE INVENTION

It is often necessary to sand or refinish large areas of flooring, such as basketball gyms, ballrooms or the like. In order to make this job easier and less time consuming, the use of riding trailers has been employed. Thus, the sander, e.g., a drum sander, or other implement is hitched or otherwise coupled to a trailer. A human being, sitting atop this trailer, controls both the trailer and the implement and, overall, gets the job done faster than if he/she had to walk behind the implement.

One such riding trailer or attachment is disclosed in Neitzer, Jr. U.S. Pat. No. 3,161,994. The Neitzer, Jr. riding attachment includes two propelling and supporting wheels mounted on an axle driven by an electrical motor through a drive assembly including belts, pulleys, a chain and sprocket. In addition, this attachment has a separate steering lever which is coupled to a caster on the sander. Thus, the operator of the attachment indirectly steers the sander by manipulating the steering lever on the attachment to steer the caster. This riding attachment has several drawbacks. For example, the relatively complex drive assembly between the electric motor and the axle may be prone to frequent breakdowns and may require substantial maintenance. In addition, the feature in which the sander is indirectly steered using a steering lever on the attachment reduces the amount of control of and "feel" for the sander the operator has.

Another riding trailer is disclosed in Mattson, U.S. Pat. No. Re. 34,822, which is incorporated herein in its entirety by this specific reference. The Mattson patent discloses a power riding trailer for an implement which utilizes a non-gasoline powered motor and a hydraulic transmission for propelling the trailer forward.

Although this prior art power riding trailer greatly facilitates floor treatment operations, there is a need for a relatively smaller, more conveniently sized power riding trailer that is more easily maneuverable and can be used in both large and small scale operations. A riding trailer of simpler construction which is capable of use in smaller residential rooms as well as larger commercial rooms would clearly be advantageous.

SUMMARY OF THE INVENTION

The present invention provides a vehicle or trailer apparatus, more particularly a riding trailer apparatus, useful for propelling and/or controlling a floor treatment implement. More particularly, the present invention relates to such an apparatus which is effective, simple and straightforward in construction, easy to operate, subject to reduced wear and tear and has reduced maintenance requirements.

A riding trailer apparatus in accordance with the present invention generally comprises a frame having a rear portion and a forward portion, an operator support platform coupled to the frame, a hook-up mechanism disposed on the frame forward portion and structured to enable a floor treatment implement to be operatively coupled to the apparatus, and a drive assembly structured to drive the apparatus, for example, while the apparatus is operative and coupled to the implement. More specifically, the drive assembly includes a powered wheel assembly, a drive unit operatively coupled to the powered wheel assembly, and an electronic controller operatively coupled to the drive unit and effective to enhance operator control of the drive unit.

In one particularly advantageous embodiment of the invention, the drive unit includes a motor, for example a bi-directional DC motor, and a gear assembly operably connected thereto. Preferably, the controller comprises an electronic cotroller, and is preferably effective to control at least one of a speed and a direction of the drive unit. Preferably, the controller includes an AC to DC converter (hereinafter "AC-DC converter"). In addition, the controller preferably further comprises a potentiometer, for example, a variable speed potentiometer operably connected to the drive unit and structured to control a speed of the drive unit. For example, the potentiometer is structured and adapted to control a speed of the motor in response to movement of an operator controlled foot pedal.

The drive assembly preferably further includes a convenient manually operable mechanism connected to the drive unit for initiating movement of the apparatus. For example, the manually operable mechanism comprises a foot pedal, for example, a foot pedal that is used to initiate start up and movement of the apparatus in either a forward direction or reverse direction. The foot pedal is preferably disposed at a convenient location relative to the operator support platform, for example, the foot pedal is disposed on a frame forward portion.

In one particularly advantageous embodiment of the invention, the electronic controller is structured to control a ground speed of the apparatus in both a forward direction and a reverse direction. Specifically, the controller preferably comprises no more than a single variable speed pot, or potentiometer, for controlling ground speed of the apparatus in both a forward direction and a reverse direction. Even more specifically, the controller comprises a single potentiometer operably connected to the drive unit, wherein the single potentiometer being structured to control a speed of the drive unit motor in both a forward and a reverse direction. In this embodiment the drive assembly further includes a cable assembly including a flexible cable connecting the potentiometer to the foot pedal, for example.

Advantageously, the drive assembly is structured and arranged such that the controller requires no more than a single potentiometer for controlling ground speed of the apparatus in both a forward and a reverse direction.

The apparatus may also include a non-powered wheel assembly, including for example one or more free rolling casters connected to the frame forward portion, for facilitating transport thereof.

The apparatus is preferably structured and sized so that a human being can rest, for example in a seated position, upon the operator support platform and easily control the implement coupled to the apparatus. The drive unit and the electronic controller are both sized and structured to be substantially entirely located beneath the operator support platform. The frame is preferably made of aluminum or other suitable strong, preferably lightweight material. The hook-up mechanism is structured to be highly versatile in that it can be easily adapted to operably connect the apparatus with one of a plurality of different types of conventional floor treatment implements, for example, but not limited to floor sanders, buffers, preparation, polishing and grinding machinery for concrete, marble and urethane surfaces, and other surface finishing implements.

Preferably, the drive unit is an electrically powered drive unit and is entirely powered using AC current. It preferably includes no hydraulic drive mechanism or gasoline powered motor. The drive unit and controller are preferably arranged and sized such that these components may be substantially entirely disposed beneath the operator support platform within the frame rear portion.

Advantageously, the electronic controller greatly enhances operator control of the apparatus. The controller preferably further includes a speed board, for example, a signal isolator board ("SIRC") which provides isolation between the signal voltage source and the controller for operating and controlling the potentiometer.

In another particularly advantageous feature of the invention, a disengagement mechanism is structured and positioned to enable manual disengagement of the drive unit from the powered wheel assembly. The disengagement mechanism is designed to enable an operator of the apparatus to easily disengage the powered wheel assembly from the drive unit, such that the wheels may be freely rolled in a neutral position. Preferably, this feature includes an internal, differential lock out mechanism that is operable by means of an external lever disposed at a convenient location on the frame. This feature greatly facilitates transportation of the apparatus in a non-operating mode by allowing an operator to easily disengage the drive unit so that the apparatus may be easily rolled from one place to another on the same wheels that are used for driving the apparatus.

Generally, the apparatus of the present invention is substantially smaller in size and weight, for example, the apparatus is about one third to about one half of the weight and size of prior art riding trailers, for example the power riding trailer disclosed in Mattson, U.S. Pat. No. Re. 34,822. For example, in one embodiment of the present invention, the riding trailer apparatus weighs less than about 75 pounds and has a turning radius of about 3.5 feet. Despite its small size, the apparatus of the invention is capable of driving full-sized industrial sanders, buffers and other floor treatment and finishing implements. The relatively small size and/or light weight of the present apparatus, in comparison to otherwise functionally eguivalent systems, such as that disclosed in Mattson '822, is made possible at least in part by the arrangement of the drive assembly and inclusion of the electronic speed board therein, in some of the systems of the present invention.

The relatively smaller size and power requirements of the apparatus of the present invention make the device ideal for small scale operations. For example, the apparatus may be suitable for residential use, for example for treatment of a floor in a room having a floor length of about ten feet or more.

Each and every feature described herein, and each and every combination of two or more such features is included within the scope of the invention provided that the features included in such combination are not mutually inconsistent.

The present invention and the objects and advantages thereof will be more clearly understood and appreciated with respect to the following Detailed Description, when considered in conjunction with the accompanying Drawings.

DETAILED DESCRIPTION OF THE INVENTION

Figure 1:
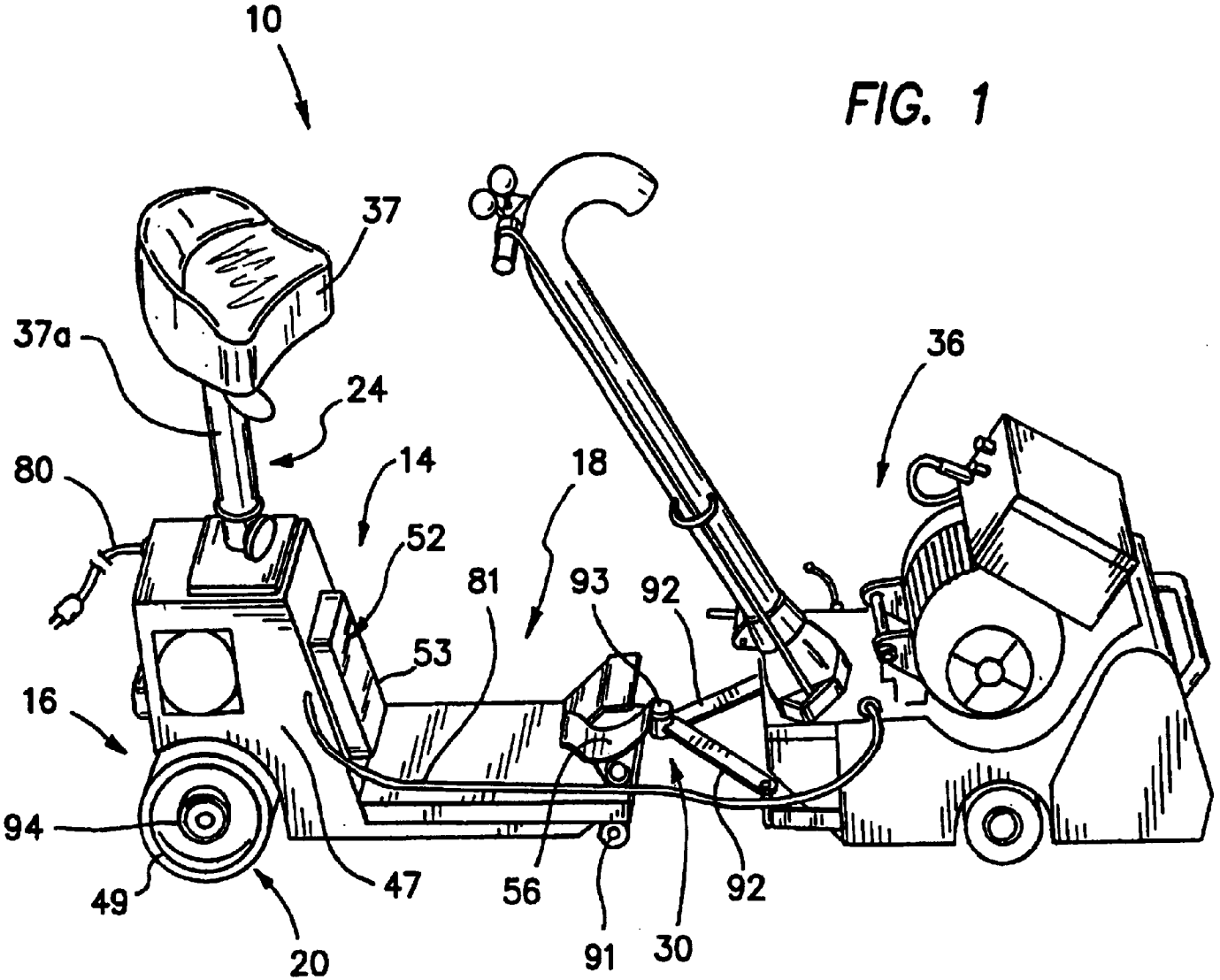
FIG. 1 shows a perspective view of a riding trailer apparatus in accordance with the present invention being used to propel a conventional floor sander implement.

Turning now to FIG. 1, a riding trailer apparatus for propelling a floor treatment implement, in accordance with the present invention, is shown generally at 10. The apparatus 10 generally comprises a frame 14 having a rear portion 16 and a forward portion 18, a powered wheel assembly 20 coupled to the frame 14, an operator support platform 24 coupled to the frame 14, and a hook-up mechanism 30 disposed on said frame forward portion 18 structured to enable a floor treatment implement 36 to be operatively coupled to the riding trailer apparatus 10.

The operator support platform 24 may include a height adjustable seat 37 coupled to a post 37*a*, or any other suitable arrangement.

Figure 2:
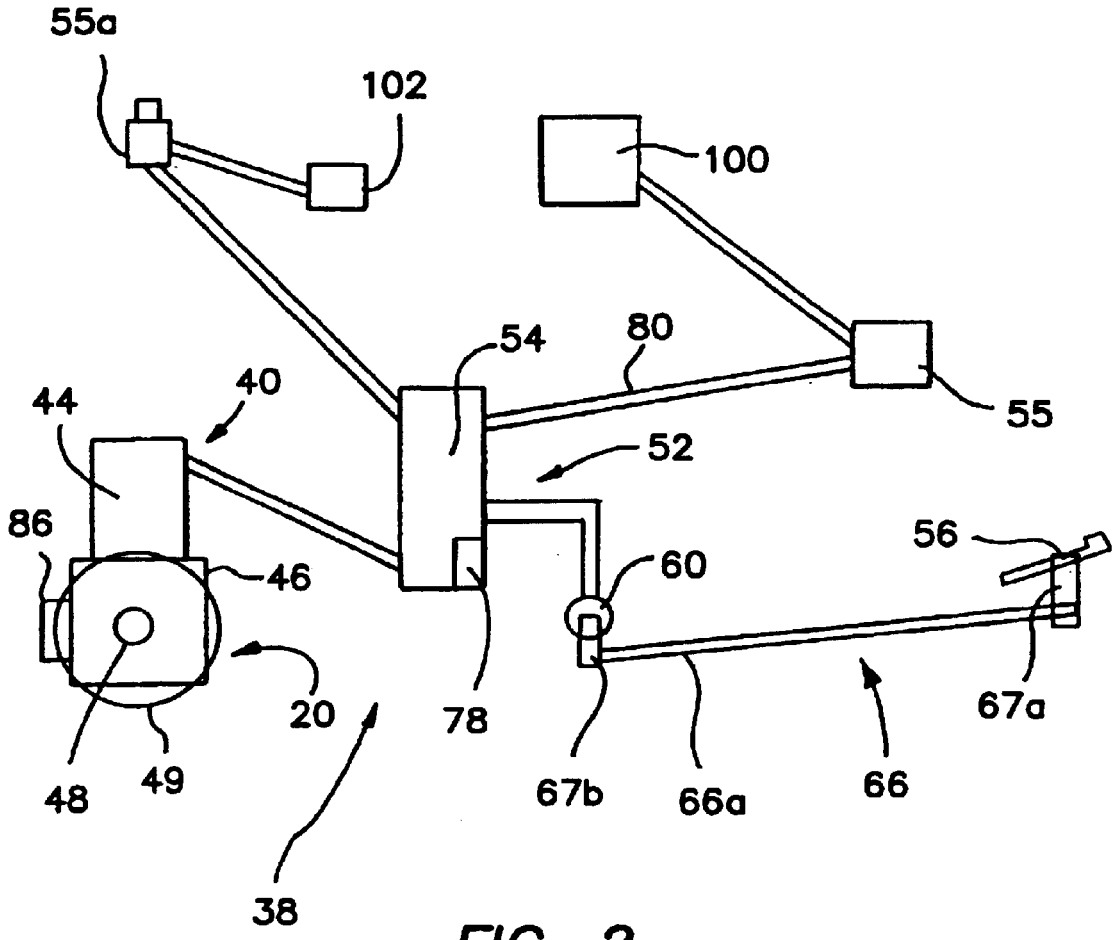
FIG. 2 shows a schematic representation of a driving assembly of the riding trailer apparatus shown in FIG. 1.

In addition, turning now as well to FIG. 2, the riding trailer apparatus 10 further comprises a drive assembly 38 including a drive unit, preferably an electrical powered drive unit 40, for propelling the powered wheel assembly 20. The apparatus 10 preferably includes no hydraulic drive mechanism or gasoline powered motor.

The drive unit 40 includes a motor 44, and gear box 46 having a gear reducer (not shown), which are both preferably contained in a compartment 47 located beneath the operator support platform 24. The gear box 46 is coupled to a drive shaft 48 of the powered wheel assembly 20. For example, the drive shaft 48 extends through the gear box 46 such as shown in FIG. 2. In the embodiment of the invention shown, the powered wheel assembly 20 is located at the rear frame portion and includes two powered wheels 49 coupled to drive shaft 48.

Preferably, the apparatus 10 of the present invention is entirely electrically powered using AC current. The motor 44 is preferably a conventional, bi-directional DC electric motor. The motor 44 and gear box 46 preferably are sized and structured to operate on about 2.7 amperes of power. The apparatus 10 preferably includes no hydraulic drive mechanism or gasoline powered motor.

Advantageously, the drive unit 40 includes a controller, specifically an electronic controller 52 that is structured to be effective in enhancing operator control and smooth, reliable operation of the apparatus 10. The drive unit 40 and controller 52 are both preferably substantially entirely located beneath the operator support platform at the rear frame portion.

In a preferred embodiment of the invention, the controller 52 includes an AC-DC converter 54 (for example 180V DC), and is structured to be connected to an AC power source 55. The AC-DC converter 54 provides a significant advantage to operation of the apparatus 10, particularly during low end RPMs. Overall, the controller 52 provides a more constant output of power to the motor 44 than is available with prior art systems, for example. This structure and arrangement ensures a relatively smooth operation of the apparatus 10 without sharp stops and starts.

Preferably, the electronic controller 52 allows forward and reverse torque to the motor 44 in both speed directions in order to control and maintain constant speed, rapid instant reversing. In addition, the controller 52 preferably is structured to include means to protect against motor overload and enhances smooth starting even during rapid cycling of incoming AC current. For example, the controller 52 may comprise a regenerative motor drive, preferably a full wave, 4-quadrant regenerative motor drive such as the regenerative motor drive manufactured and sold by KB Electronics and having model no. KBRC-240D.

Once the apparatus 10 is turned on by means of switch 55*a*, initiation of movement of the apparatus 10 may be provided by any suitable manually operable mechanism, preferably by means of a single foot pedal 56 disposed at a convenient location on the forward portion 18 of the frame 14 as shown in FIG. 1. Preferably, the drive assembly 38 is structured and operable to enable an operator to initiate start up, direction and speed to the motor 44 entirely by means of the foot pedal 56 in order to leave the operator's hands free to operate and control the implement 36.

Figure 3:
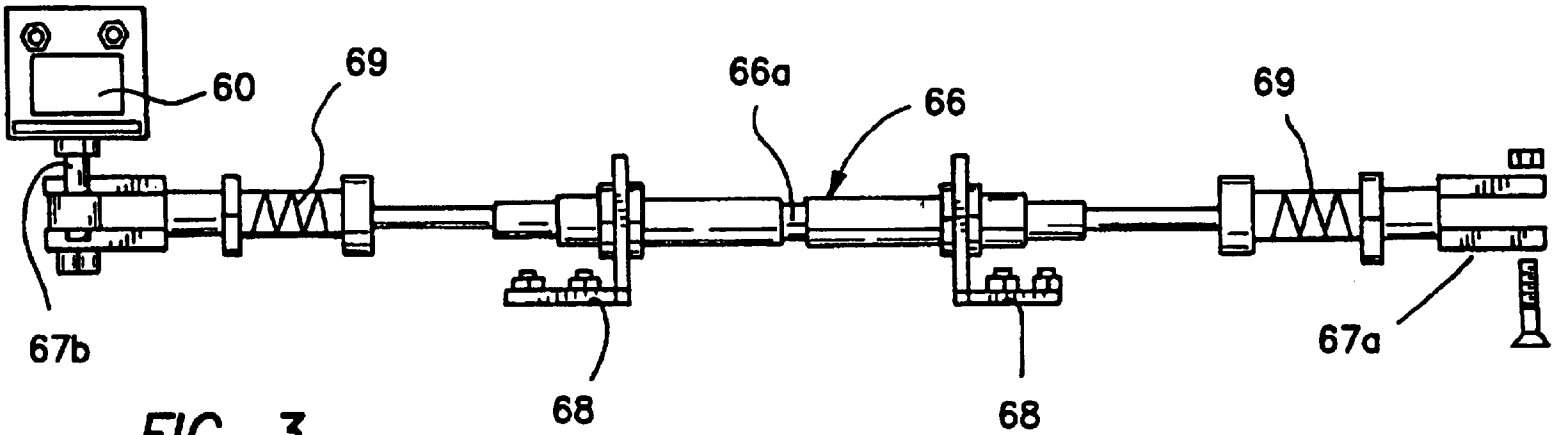
FIG. 3 shows a perspective view of a control cable connecting a foot pedal to a potentiometer of the apparatus shown in FIG. 1.

Referring now to both FIG. 2 and FIG. 3, a potentiometer 60, with voltage suitably applied thereacross as known in the art, generates a signal substantially proportional to the direction and angle of the foot pedal 56. Preferably, the potentiometer 60 comprises a single potentiometer 60, which is used to control the speed of the motor 44, and for initiating, stopping and controlling speed of both forward and reverse driving of the powered wheel assembly 20.

This may be accomplished, for example, by means of a cable assembly 66 connecting the foot pedal 56 to the potentiometer 60, which is used to control the speed of the motor 44, and for initiating, stopping and controlling speed of both forward and reverse driving of the powered wheel assembly 20.

This is preferably accomplished by the cable assembly 66 shown most clearly in FIGS. 2 and 3. For example, the cable assembly 66 includes a flexible cable 66*a*, coupling the foot pedal 56 and the potentiometer 60. The foot pedal 56 is mounted to a mechanism 67*a*, connected to one end of the cable 66*a*, and the potentiometer 60 is mounted to a rotatable shaft 67*b*, connected to an opposing end of the cable 66*a*. The cable assembly 66 includes bracket elements 68 which secure the cable assembly 66 to the forward frame portion (not shown in FIG. 3). The cable assembly 66 includes springs 69, or other suitable means for translating operator initiated motion of the foot pedal 56 to the rotatable shaft 67*b*.

This arrangement of the foot pedal 56, potentiometer 60 and cable assembly 66, as substantially described and shown herein, enables the use of a single potentiometer 60 for controlling both forward and reverse speed of the apparatus 10. Advantageously, in this embodiment of the invention, no additional potentiometers are required for controlling ground speed of the apparatus 10 in both a forward and a reverse direction.

In addition, the provision of the flexible cable 66*a*, in this arrangement, rather than for example a rigid arm or other rigid mechanical linkage, greatly enhances the reliability and smoothness of operation of the apparatus 10. The flexibility of the cable 66*a*, allows easy, quick and accurate adjustment of the performance of the apparatus 10, for example by facilitating adjustment of the response and sensitivity of the foot pedal. During assembly and maintenance of the apparatus 10, precise adjustments to the smoothness and operator control of the apparatus 10 can be made by simply adjusting the length of the flexible cable 66*a*, until desired performance level is reached. Overall, this arrangement is substantially more "user friendly" during both assembly and maintenance of the apparatus 10.

In order to even further enhance reliable and smooth operation of the apparatus 10, means are provided to isolate and/or amplify signals sent from the potentiometer 60 to the AC-DC converter. For example, an electronic speed board 78, including a signal isolator, such as a SIRC (Model KBSI-240D, manufactured by KB Electronics), is used to isolate, amplify and condition DC voltage signals from the potentiometer 60. It also provides an isolated input to control motor direction and an isolated power supply for operation of the potentiometer 60.

Turning back to FIG. 1, electrical connection between the apparatus 10 and the implement 36 can be accomplished in a number of ways. For example, electrical power may be supplied directly from source 55 to controller 52 by means of line 80, and is run through the apparatus 10 to power the implement 36 through line 81. Alternative arrangements for running electrical power through the apparatus 10 and implement 36 are contemplated and are considered to be within the scope of the invention. For example, electrical power may be supplied to both the apparatus 10 and the implement 36 through separate AC lines. Alternatively, power may be supplied initially to the implement 36 and then to the apparatus 10 from an extension cord extending between the apparatus 10 and implement 36.

Figure 4:
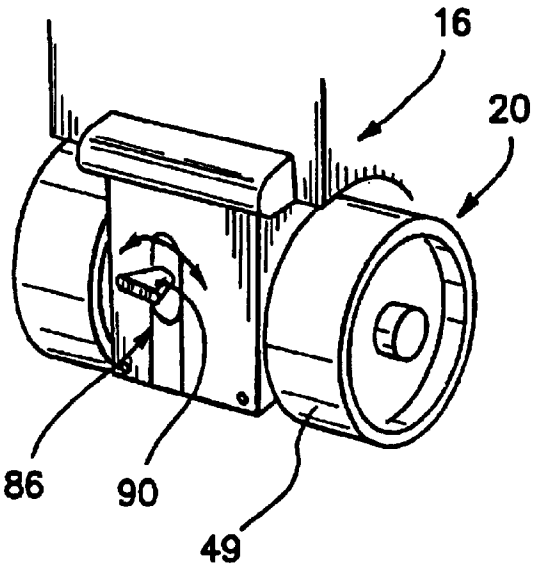
FIG. 4 shows a rear portion of the apparatus shown in FIG. 1, including a differential lock out lever for disengaging a powered wheel assembly from the driving assembly.

In addition, referring now to FIG. 2 and FIG. 4, preferably the apparatus 10 further comprises a disengagement mechanism 86 for disconnecting the powered wheel assembly 20 from the drive unit 40. Preferably, the disengagement mechanism 86 comprises a differential lock out mechanism which enables any operator to shift the drive unit 40 into a neutral position, thereby freeing the powered wheel assembly 20 and allowing the apparatus 10 to be manually maneuvered from place to place. A lever 90, shown in FIG. 4, may be provided in a convenient location which connects to the internal differential lock out mechanism. Advantageously, when the powered wheel assembly 20 is placed in a neutral position, the apparatus can be rolled and maneuvered along ramps and through narrow passageways between rooms to be treated, without the need for an operator to manually "tip" the apparatus 10 onto casters 91.

Figure 5:
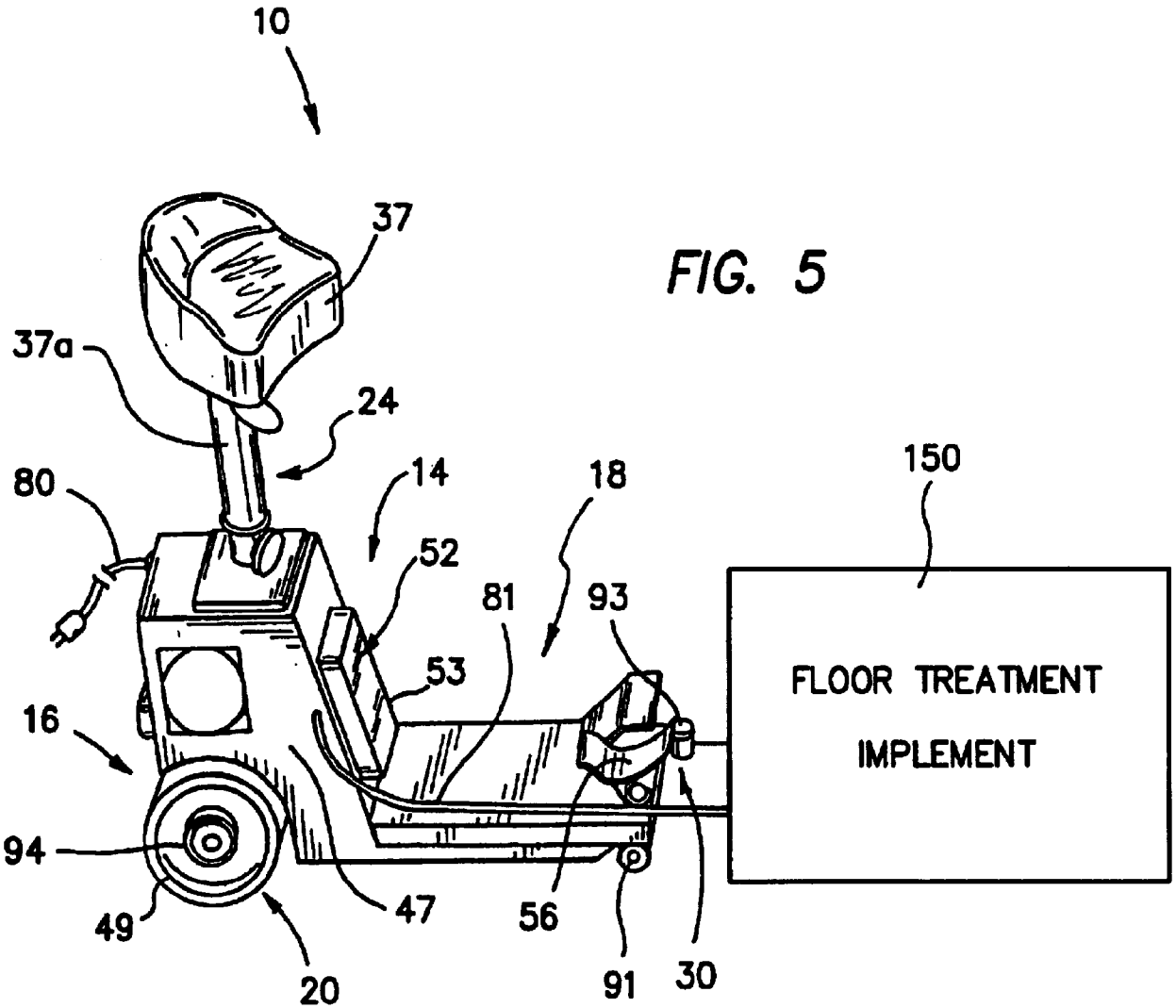
FIG. 5 shows a perspective view of a riding trailer apparatus in accordance with the present invention being used to propel one of a variety of floor treatment implements.

Turning to FIG. 5, the hook-up mechanism 30 of the apparatus 10 is preferably structured to enable a variety of different types of floor treatment implements to be operatively coupled to the apparatus, for example, but not limited to conventional floor refinishing equipment 150, such as for example floor sanders, buffers, surface finishing implements, and concrete prep machinery.

This may be accomplished in a variety of ways. For example, as shown in FIG. 1, the hook up mechanism 30 may include connectors 92, coupled to a ball joint hook-up mechanism 93. Many other arrangements may be provided, with interchangeable hardware for accommodating various different types of implements. Such other arrangements can be devised by a person or ordinary skill in the art, and thus are not described in great detail herein.

Preferably, for connecting the apparatus 10 to a particularly heavy piece of equipment, such as, for example, a dual sander implement, one of more counterbalance elements 94, for example weights of about 15 pounds, are provided. Such weights are structured and adapted may be removably attached to apparatus 10 at wheels 49. In some cases, additional weights may be provided which are structured to be removably secured to the implement.

Other arrangements for connecting various floor treatment implements to the apparatus 10, as will be known to those of skill in the art, are possible and are considered to be included within the scope of the invention.

As shown in FIG. 2, the apparatus 10 preferably includes a cooling fan 100 coupled to the incoming power source 55. The apparatus 10 may optionally include an hour meter 102 for measuring and monitoring duration of time the apparatus 10 has been used for a particular job or application.

Advantageously, the apparatus 10 is sized and structured to be no greater than about 75 pounds (not including weight of any counterbalance elements 94), and thus is approximately only one-third to about one-half of the size and weight of a conventional riding trailer, for example the riding trailer disclosed in Mattson, U.S. Pat. No. RE. 34,822.

While this invention has been described with respect to various specific examples and embodiments, it is to be understood that the invention is not limited thereto and that it can be variously practiced within the scope of the following claims.

What is claimed is:

1. A riding trailer apparatus for propelling a floor treatment implement, the apparatus comprising:

a frame having a rear portion and a forward portion;

an operator support platform coupled to the frame;

a manually operable mechanism, disposed on the frame, structured and positioned to enable operator control of the apparatus;

a hook-up mechanism disposed on the frame and structured to enable a floor treatment implement to be operatively coupled to the riding trailer apparatus;

a drive assembly, connected to the frame, including a powered wheel assembly, a drive unit operatively coupled to the powered wheel assembly, and an electronic controller, including an electronic speed board operatively coupled to the drive unit and effective to enhance operator control of the drive unit and a potentiometer operably connected to the drive unit and structured to control a speed of the drive unit; and a cable control including a flexible cable operatively connecting the potentiometer with the manually operable mechanism.

2. The apparatus of claim 1 wherein the electronic controller is structured to control at least one of a speed and a direction of the drive unit.

3. The apparatus of claim 1 wherein the electronic controller comprises an AC-DC converter.

4. The apparatus of claim 1 wherein the electronic controller comprises a single potentiometer operably connected to the drive unit, the single potentiometer being structured to control a speed of the drive unit in both a forward direction and a reverse direction.

5. The apparatus of claim 1 wherein the cable control further includes two springs disposed near opposing end portions of the flexible cable.

6. The apparatus of claim 1 wherein the manually operable mechanism comprises a foot pedal connected to one of the opposing end portions of the flexible cable on the forward portion of the frame.

7. The apparatus of claim 1 wherein the electronic controller comprises a regenerative drive structured to allow forward and reverse torque to the drive unit.

8. The apparatus of claim 1 wherein the hook-up mechanism is structured to be connectable to at least one of a conventional floor sander implement, a conventional floor buffer implement, and a conventional surface finishing implement.

9. The apparatus of claim 1 wherein the hook-up mechanism is structured to be connectable to a conventional floor buffer implement.

10. The apparatus of claim 1 wherein the hook-up mechanism is structured to be connectable to a conventional surface finishing implement.

11. The apparatus of claim 1 wherein the hook-up mechanism comprises a plurality of interchangeable hook-up assemblies for accommodating a plurality of conventional floor treatment implements.

12. The apparatus of claim 1 wherein the drive unit and electronic controller are both substantially entirely located beneath the operator support platform.

13. The apparatus of claim 1 wherein the electronic speed board includes a signal isolator effective to at least one of isolate and amplify voltage signals sent from the potentiometer to the drive unit.

14. The apparatus of claim 1 that has a weight of less than about half of a weight of a substantially functionally identical system having no electronic speed board.

15. The apparatus of claim 1 further comprising a disengagement mechanism structured and positioned to enable manual disengagement of the drive unit from the powered wheel assembly.

16. The apparatus of claim 15 wherein the disengagement mechanism comprises a differential lock out mechanism operatively connected to the drive unit.

17. The apparatus of claim 16 wherein the disengagement mechanism further comprises a disengagement lever disposed on the frame.

18. A riding trailer apparatus for propelling a floor treatment implement, the apparatus comprising:

a frame having a rear portion and a forward portion;

an operator support platform coupled to the frame;

a manually operable mechanism, disposed on the frame, structured and positioned to enable operator control of the apparatus;

a hook-up mechanism disposed on the frame and structured to enable a floor treatment implement to be operatively coupled to the riding trailer apparatus;

a drive assembly, connected to the frame, including a powered wheel assembly, a drive unit operatively coupled to the powered wheel assembly, and an electronic controller, including an electronic speed board operatively coupled to the drive unit and effective to enhance operator control of the drive unit; and a disengagement mechanism structured and positioned to enable manual disengagement of the drive unit from the powered wheel assembly, the disengagement mechanism comprising a differential lock-out mechanism operatively coupled to the drive unit.

19. The apparatus of claim 18 wherein the disengagement mechanism further comprises a disengagement lever disposed on the frame.

* * * * *